US007648601B2

(12) United States Patent
Hasegawa et al.

(10) Patent No.: US 7,648,601 B2
(45) Date of Patent: Jan. 19, 2010

(54) HIGH-STRENGTH, HIGH-CONDUCTIVITY COPPER ALLOY WIRE EXCELLENT IN RESISTANCE TO STRESS RELAXATION

(75) Inventors: Katsumasa Hasegawa, Tokyo (JP); Kuniteru Mihara, Tokyo (JP); Katsuhiko Uda, Tokyo (JP); Takashi Miyoshi, Tokyo (JP)

(73) Assignee: Furukawa Electric Co., Ltd., Tokyo (JP)

( * ) Notice: Subject to any disclaimer, the term of this patent is extended or adjusted under 35 U.S.C. 154(b) by 333 days.

(21) Appl. No.: 11/373,329

(22) Filed: Mar. 13, 2006

(65) Prior Publication Data

US 2006/0196586 A1 Sep. 7, 2006

Related U.S. Application Data

(60) Division of application No. 10/936,664, filed on Sep. 9, 2004, now abandoned, which is a continuation of application No. PCT/JP03/002914, filed on Mar. 12, 2003.

(30) Foreign Application Priority Data

Mar. 12, 2002 (JP) ..... 2002-67602

(51) Int. Cl.
*C22C 9/06* (2006.01)

(52) U.S. Cl. ..... 148/682

(58) Field of Classification Search ..... 148/682
See application file for complete search history.

(56) References Cited

FOREIGN PATENT DOCUMENTS

| | | | |
|---|---|---|---|
| DE | 19643378 A1 | | 6/1997 |
| EP | 0 949 343 | | 10/1999 |
| JP | 63130739 A | | 6/1988 |
| JP | 3-6341 | | 1/1991 |
| JP | 05-125469 | * | 5/1993 |
| JP | 5-125469 | | 5/1993 |
| JP | 5-279825 | | 10/1993 |
| JP | 07090520 | * | 4/1995 |
| JP | 11-256256 | | 9/1999 |

OTHER PUBLICATIONS

International Search Report issued by Japanese Patent Office on Jun. 17, 2003.
German Office Action issued in corresponding Application No. 103 92 428.0-24 dated Oct. 31, 2006.

* cited by examiner

*Primary Examiner*—Sikyin Ip
(74) *Attorney, Agent, or Firm*—Westerman, Hattori, Daniels & Adrian, LLP

(57) ABSTRACT

A high-strength, high conductivity copper alloy wire that is excellent in resistance to stress relaxation, which contains 1.0 to 4.5% by mass of Ni, 0.2 to 1.1% by mass of Si, 0.05 to 1.5% by mass of Sn, and less than 0.005% (including zero) by mass of S, with the balance being Cu and inevitable impurities, wherein the wire has a conductivity of from 20% to 60% IACS and a tensile strength of from 700 to 1,300 MPa, and a method of producing the same.

4 Claims, No Drawings

HIGH-STRENGTH, HIGH-CONDUCTIVITY COPPER ALLOY WIRE EXCELLENT IN RESISTANCE TO STRESS RELAXATION

This application is a divisional of application Ser. No. 10/936,664, filed Sep. 9, 2004, now abandoned, which is a continuation of International Application PCT/JP03/002914, filed Mar. 12, 2003.

TECHNICAL FIELD

The present invention relates to a high-strength, high-conductivity copper alloy wire excellent in resistance to stress relaxation, and to a method for producing the same.

BACKGROUND ART

Hitherto, a worked beryllium-copper alloy prepared by adding beryllium to copper has exclusively been used for wire products required to have high strength and high conductivity. On the other hand, precipitation type alloys have been seldom used in the field of wires.

However, the conventional wires, represented by wires using beryllium copper alloy, have involved the following problems:

(1) Beryllium copper alloy is more expensive than alloys such as phosphor bronze;

(2) Hygiene and safety problems for the workers may arise with use of beryllium, a harmful substance;

(3) While phosphor bronze is used as a substitute for beryllium copper alloy, both the conductivity and strength of the former are low;

(4) The strength of a low-beryllium copper alloy (a beryllium content of 1.0% by mass or less) is low; and (5) While high-beryllium copper alloy (a beryllium content of 1.5% by mass or more) has low conductivity and high strength, the quality is too good for the recent service life of the product.

DISCLOSURE OF INVENTION

The present invention resides in a high-strength, high-conductivity copper alloy wire that is excellent in resistance to stress relaxation, which comprises 1.0 to 4.5% by mass of Ni, 0.2 to 1.1% by mass of Si, 0.05 to 1.5% by mass of Sn, and less than 0.005% (including zero) by mass of S, with the balance being Cu and inevitable impurities, wherein the wire has a conductivity of from 20% to 60% IACS, and a tensile strength of from 700 to 1,300 MPa.

Further, the present invention resides in a high-strength, high-conductivity copper alloy wire that is excellent in resistance to stress relaxation, which comprises 1.0 to 4.5% by mass of Ni, 0.2 to 1.1% by mass of Si, 0.05 to 1.5% by mass of Sn, 0.2 to 1.5% by mass of Zn, and less than 0.005% (including zero) by mass of S, with the balance being Cu and inevitable impurities, wherein the wire has a conductivity of from 20% to 60% IACS, and a tensile strength of from 700 to 1,300 MPa.

Further, the present invention resides in a high-strength, high-conductivity copper alloy wire that is excellent in resistance to stress relaxation, which comprises any one of the above stated copper alloys which further contains at least one or plural elements selected from the group consisting of 0.005 to 0.3% by mass of Ag, 0.01 to 0.5% by mass of Mn, 0.01 to 0.2% by mass of Mg, 0.005 to 0.2% by mass of Fe, 0.005 to 0.2% by mass of Cr, 0.05 to 2% by mass of Co, and 0.005 to 0.1% by mass of P, in a total amount of 0.005 to 2% by mass, wherein the wire has a conductivity of from 20% to 60% IACS, and a tensile strength of from 700 to 1,300 MPa.

Further, the present invention resides in a method for producing a high-strength, high-conductivity copper alloy wire that is excellent in resistance to stress relaxation, which comprises: rough drawing a copper alloy, comprising 1.0 to 4.5% by mass of Ni, 0.2 to 1.1% by mass of Si, 0.05 to 1.5% by mass of Sn, and less than 0.005% (including zero) by mass of S, with the balance being Cu and inevitable impurities, to form a wire rod; subjecting the wire rod to a solution treatment; and subjecting the wire rod to at least one step selected from an aging treatment and drawing, thereby obtaining a copper alloy wire having a conductivity of from 20% to 60% IACS and a tensile strength of from 700 to 1,300 MPa.

Further, the present invention resides in a method for producing a high-strength, high-conductivity copper alloy wire that is excellent in resistance to stress relaxation, which comprises: rough drawing a copper alloy comprising 1.0 to 4.5% by mass of Ni, 0.2 to 1.1% by mass of Si, 0.05 to 1.5% by mass of Sn, 0.2 to 1.5% by mass of Zn and less than 0.005% (including zero) by mass of S, with the balance being Cu and inevitable impurities, to form a wire rod; subjecting the wire rod to a solution treatment; and subjecting the wire rod to at least one step selected from an aging treatment and drawing, thereby obtaining a wire having a conductivity of from 20% to 60% IACS and a tensile strength of from 700 to 1,300 MPa.

Besides, the present invention resides in a method for producing a high-strength, high-conductivity copper alloy wire that is excellent in resistance to stress relaxation, which comprises: rough drawing any one of the above-mentioned copper alloys further containing at least one or plural elements selected from the group consisting of 0.005 to 0.3% by mass of Ag, 0.01 to 0.5% by mass of Mn, 0.01 to 0.2% by mass of Mg, 0.005 to 0.2% by mass of Fe, 0.005 to 0.2% by mass of Cr, 0.05 to 2% by mass of Co, and 0.005 to 0.1% by mass of P, in a total amount of 0.005 to 2% by mass, to form a wire rod; subjecting the wire rod to a solution treatment; and subjecting the wire rod to at least one step selected from an aging treatment and drawing, thereby obtaining a copper alloy wire having a conductivity of from 20% to 60% IACS and a tensile strength of from 700 to 1,300 MPa.

Other and further features and advantages of the present invention will appear more fully from the following description.

BEST MODE FOR CARRYING OUT THE INVENTION

According to the present invention, there are provided the following means:

(1) A high-strength, high-conductivity copper alloy wire that is excellent in resistance to stress relaxation, comprising 1.0 to 4.5% by mass of Ni, 0.2 to 1.1% by mass of Si, 0.05 to 1.5% by mass of Sn, and less than 0.005% (including zero) by mass of S, with the balance being Cu and inevitable impurities, wherein the wire has a conductivity of from 20% to 60% IACS, and a tensile strength of from 700 to 1,300 MPa;

(2) A high-strength, high-conductivity copper alloy wire that is excellent in resistance to stress relaxation, comprising 1.0 to 4.5% by mass of Ni, 0.2 to 1.1% by mass of Si, 0.05 to 1.5% by mass of Sn, 0.2 to 1.5% by mass of Zn, and less than 0.005% (including zero) by mass of S, with the balance being Cu and inevitable impurities, wherein the wire has a conductivity of from 20% to 60% IACS, and a tensile strength of from 700 to 1,300 MPa;

(3) A high-strength, high-conductivity copper alloy wire that is excellent in resistance to stress relaxation according to (1) or (2), further containing at least one or plural elements selected from the group consisting of 0.005 to 0.3% by mass of Ag, 0.01 to 0.5% by mass of Mn, 0.01 to 0.2% by mass of Mg, 0.005 to 0.2% by mass of Fe, 0.005 to 0.2% by mass of Cr, 0.05 to 2% by mass of Co, and 0.005 to 0.1% by mass of P in a total amount of 0.005 to 2% by mass, wherein the wire has a conductivity of from 20% to 60% IACS, and a tensile strength of from 700 to 1,300 MPa;

(4) A method for producing a high-strength, high-conductivity copper alloy wire that is excellent in resistance to stress relaxation, comprising: rough drawing a copper alloy comprising 1.0 to 4.5% by mass of Ni, 0.2 to 1.1% by mass of Si, 0.05 to 1.5% by mass of Sn, and less than 0.005% (including zero) by mass of S, with the balance being Cu and inevitable impurities, to form a wire rod; subjecting the wire rod to a solution treatment; and subjecting the wire rod to at least one step selected from an aging treatment and drawing, thereby obtaining a copper alloy wire having a conductivity of from 20% to 60% IACS and a tensile strength of from 700 to 1,300 MPa;

(5) A method for producing a high-strength, high-conductivity copper alloy wire that is excellent in resistance to stress relaxation, comprising: rough drawing a copper alloy comprising 1.0 to 4.5% by mass of Ni, 0.2 to 1.1% by mass of Si, 0.05 to 1.5% by mass of Sn, 0.2 to 1.5% by mass of Zn, and less than 0.005% (including zero) by mass of S, with the balance being Cu and inevitable impurities, to form a wire rod; subjecting the wire rod to a solution treatment; and subjecting the wire rod to at least one step selected from an aging treatment and drawing, thereby obtaining a copper alloy wire having a conductivity of from 20% to 60% IACS and a tensile strength of from 700 to 1,300 MPa.

(6) A method for producing a high-strength, high-conductivity copper alloy wire that is excellent in resistance to stress relaxation, comprising: rough drawing the copper alloy according to (1) or (2), further containing at least one or plural elements selected from the group consisting of 0.005 to 0.3% by mass of Ag, 0.01 to 0.5% by mass of Mn, 0.01 to 0.2% by mass of Mg, 0.005 to 0.2% by mass of Fe, 0.005 to 0.2% by mass of Cr, 0.05 to 2% by mass of Co, and 0.005 to 0.1% by mass of P in a total amount of 0.005 to 2% by mass, to form a wire rod; subjecting the wire rod to a solution treatment; and subjecting the wire rod to at least one step selected from an aging treatment and drawing, thereby obtaining a copper alloy wire having a conductivity of from 20% to 60% IACS and a tensile strength of from 700 to 1,300 MPa.

(7) A method for producing a high-strength, high-conductivity copper alloy wire that is excellent in resistance to stress relaxation, comprising: rough drawing the copper alloy according to any one of (1) to (3), to form a wire rod; subjecting the wire rod to a solution treatment; drawing the wire rod at a reduction ratio of from 0 to 4, aging at from 400° C. to 550° C. for 1.5 hours or more, and drawing at a reduction ratio of 3 or more, thereby obtaining a copper alloy wire having a tensile strength of 1,000 MPa or more (generally 1,300 MPa or less) and a conductivity of 20% IACS or more (generally 60% IACS or less);

(8) A method for producing a high-strength, high-conductivity copper alloy wire that is excellent in resistance to stress relaxation, comprising: rough drawing the copper alloy according to any one of (1) to (3), to form a wire rod; subjecting the wire rod to a solution treatment; drawing the wire rod at a reduction ratio of from 0 to 4; aging at from 400° C. to 550° C. for 1.5 hours or more; drawing at a reduction ratio of 3 or more; and annealing at from 350° C. to 500° C. for 1.5 hours or more, thereby obtaining a copper alloy wire having a conductivity of 40% IACS or more (generally 60% IACS or less) and a tensile strength of 700 MPa or more (generally 1,300 MPa or less);

(9) A method for producing a high-strength, high-conductivity copper alloy wire that is excellent in resistance to stress relaxation, comprising: rough drawing the copper alloy according to any one of (1) to (3), to form a wire rod; subjecting the wire rod to a solution treatment; and drawing the wire rod at a reduction ratio of 7 or more, thereby obtaining a copper alloy wire having a tensile strength of 1,000 MPa or more (generally 1,300 MPa or less) and a conductivity of 20% IACS or more (generally 60% IACS or less);

(10) A method for producing a high-strength, high-conductivity copper alloy wire that is excellent in resistance to stress relaxation, comprising: rough drawing the copper alloy according to any one of (1) to (3), to form a wire rod; subjecting the wire rod to a solution treatment; drawing at a reduction ratio of 7 or more; and annealing at such a temperature of from 200° C. to 400° C. as not to deteriorate the tensile strength for 1.5 hours or more, thereby obtaining a copper alloy wire having a tensile strength of 1,000 MPa or more (generally 1,300 MPa or less) and a conductivity of 20% IACS or more (generally 60% IACS or less);

(11) A method for producing a high-strength, high-conductivity copper alloy wire that is excellent in resistance to stress relaxation, comprising: rough drawing the copper alloy according to any one of (1) to (3), to form a wire rod; subjecting the wire rod to a solution treatment; drawing at a reduction ratio of 3 or more; aging at from 400° C. to 600° C. for 1.5 hours or more; and drawing at a reduction ratio of from 0 to less than 3, thereby obtaining a copper alloy wire having a conductivity of 40% IACS or more (generally 60% IACS or less) and a tensile strength of 700 MPa or more (generally 1,300 MPa or less);

(12) A method for producing a high-strength, high-conductivity copper alloy wire that is excellent in resistance to stress relaxation, comprising: rough drawing the copper alloy according to any one of (1) to (3), to form a wire rod; subjecting the wire rod to a solution treatment; drawing at a reduction ratio of from 0.7 to 4; aging at from 400° C. to 600° C. for 1.5 hours or more; and drawing at a reduction ratio of less than 6, thereby obtaining a copper alloy wire having a tensile strength of from 900 to 1100 MPa and a conductivity of from 30% to 45% IACS;

(13) A method for producing a high-strength, high-conductivity copper alloy wire that is excellent in resistance to stress relaxation, comprising: rough drawing the copper alloy according to any one of (1) to (3), to form a wire rod; subjecting the wire rod to a solution treatment; drawing at a reduction ratio of from 0 to 4; aging at from 400° C. to 600° C. for 1.5 hours or more; and then repeating a set of steps (I) and (II) twice or more, in which step (I) is a step of drawing at a reduction ratio of exceeding 0 and 4 or less, and step (II) after step (I) is a step of annealing at a temperature lower than the first aging temperature in a range of 300° C. to 550° C. for 1.5 hours or more; and drawing at a reduction ratio of from 0 to 4, thereby obtaining a copper alloy wire having a tensile strength of from 900 to 1100 MPa and a conductivity of from 30% to 45% IACS; and

(14) A method for producing a high-strength, high-conductivity copper alloy wire that is excellent in resistance to stress relaxation, comprising: rough drawing the copper alloy according to any one of (1) to (3), to form a wire rod; subjecting the wire rod to a solution treatment; and aging at from 400° C. to 600° C. for 1.5 hours or more, thereby obtaining a copper alloy wire having a tensile strength of from 700 to 1100 MPa and a conductivity of from 20% to 50% IACS.

The present invention will be described below in more detail.

Each component contained in a high-strength, high conductivity alloy wire of the present invention used for parts of electronic and electric machinery and tools will be explained at first.

It is known in the art that adding Ni and Si to Cu increases strength and electric conductivity of the alloy owing to precipitation of a Ni—Si compound (a $Ni_2Si$ phase) in the Cu matrix.

A desired mechanical strength cannot be obtained when the content of Ni is less than 1.0% by mass due to a small amount of the precipitates. When the content of added Ni exceeds 4.5% by mass, on the contrary, precipitates that would not contribute to increase of strength are generated during casting and heat treatment (for example a solution treatment, an aging treatment and an annealing treatment) and cause not only failure in obtaining the strength comparable to the amount of the addition, but also adverse effect on drawing property and bending property.

Regarding the content of Si, the most proper amount of addition of Si is determined by determining the amount of addition of Ni, since the precipitation of the compound of Ni and Si is considered to mainly comprise the $Ni_2Si$ phase. A sufficient strength cannot be obtained when the content of Si is less than 0.2% by mass, as when the content of Ni is small. On the contrary, the same problem as when the content of Ni is large arises when the content of Si exceeds 1.1% by mass.

The content of Ni is adjusted to be preferably 1.7 to 4.5% by mass, more preferably 2.0 to 4.0% by mass, and the content of Si is adjusted to be preferably 0.4 to 1.1% by mass, more preferably 0.45 to 1.0% by mass.

Sn and Zn are crucial added elements for constituting the present invention. A good balance of characteristics is attained by a mutual interaction of these elements.

Sn improves resistance to stress relaxation as well as drawing property. Such improving effects cannot be manifested when the content of Sn is less than 0.05% by mass, while electric conductivity decreases by adding more than 1.5% by mass of Sn.

Zn is able to improve bending property. Zn is preferably added in a proportion of 0.2% by mass or more, since Zn can improve resistance to peeling under heat of Sn plating and solder plating, and resistance to migration. On the other hand, adding more than 1.5% by mass of Zn is not preferable considering the electric conductivity.

The content of Sn is preferably 0.05 to 1.0% by mass, more preferably 0.1 to 0.5% by mass, while the content of Zn is preferably 0.2 to 1.0% by mass, more preferably 0.4 to 0.6% by mass, in the present invention.

S is an element that makes hot workability to be deteriorated, and the content thereof is restricted to be less than 0.005% by mass. It is particularly preferable to restrict the content of S in the range of 0 to less than 0.002% by mass.

The reasons for restricting the contents of Ag, Mn, Mg, Fe, Cr, Co and P in the case where these elements are contained will be described hereinafter. Ag, Mn, Mg, Fe, Cr, Co and P have similar functions with each other with respect to improving formability. The total content of one or plural elements selected from Ag, Mn, Mg, Fe, Cr, Co and P, if any, is 0.005 to 2% by mass, preferably 0.03 to 1.5% by mass.

Ag improves heat resistance and strength while improving bending property by preventing crystal grains from being coarse. The effect cannot be fully attained at a content of Ag of less than 0.005% by mass, while adding an amount of exceeding 0.3% by mass increases the production cost, although the amount does not adversely affect the characteristics. From these view points, the content of Ag, if any, is 0.005% to 0.3% by mass, preferably 0.01 to 0.2% by mass.

Mn is effective for increasing the strength while improving hot workability. A content of Mn of less than 0.01% by mass gives only a small effect, while a content of exceeding 0.5% by mass not only gives no effect comparable to the amount of addition but also deteriorates the electric conductivity. Accordingly, the content of Mn, if any, is 0.01 to 0.5% by mass, preferably 0.1 to 0.35% by mass.

Although Mg improves resistance to stress relaxation, bending property is adversely affected by Mg. The content of Mg is desirably 0.01% by mass or more from the view point of resistance to stress relaxation, and the larger the content is better. On the contrary, good bending property is difficult to be obtained when the content exceeds 0.2% by mass with respect to improvement of bending property. Accordingly, the content of Mg, if any, is 0.01 to 0.2% by mass, preferably 0.05 to 0.15% by mass.

Fe and Cr combine with Si to form a Fe—Si compound and Cr—Si compound, which increase the strength. The elements trap Si remaining in the copper matrix without forming a compound with Ni, thereby being effective for improving the electric conductivity. Since the Fe—Si compound and Cr—Si compound have a low precipitation hardening ability, it is not advantageous to form a large amount of these compounds. Bending property becomes deteriorated when the contents of Fe or Cr exceeds 0.2% by mass. Accordingly, the contents of Fe and Cr, if any, are 0.005 to 0.2% by mass, preferably 0.03 to 0.15% by mass, respectively.

Co forms a compound with Si, as Ni does, to improve the strength. While Cu—Ni—Si series alloys are used because Co is more expensive than Ni, Cu—Co—Si series alloys and Cu—Ni—Co—Si series alloys may be selected in the present invention if they are acceptable considering the cost. The strength and electric conductivity of the Cu—Co—Si series alloys are improved by aging precipitation and slightly better than those of the Cu—Ni—Si series alloys. Accordingly, the former alloys are effective in the members in which thermal conductivity and electric conductivity are important. Since the Co—Si compound has a slightly higher precipitation hardening ability, resistance to stress relaxation also tends to be a little improved. Accordingly, the content of Co, if any, is 0.05 to 2% by mass, preferably 0.08 to 1.5% by mass.

Phosphor (P) has an effect for increasing the strength while improving the electric conductivity. A large content of P decreases bending property owing to enhanced grain boundary precipitation. Accordingly, the content of P, if any, is preferably 0.005 to 0.1% by mass, more preferably 0.01 to 0.05% by mass.

While the amount of addition of at least two of these elements above at the same time may be appropriately determined depending on the required characteristics, the total content of them was determined to be 0.005 to 2.0% by mass, considering heat resistance, resistance to peeling under heat of the Sn plating, resistance to peeling under heat of the solder plating and electric conductivity.

In the present invention, other elements, for example, B, Ti, Zr, V, Al, Pb and Bi, may be added in such a total content of generally 0.01 to 0.5% by mass, and preferably 0.01 to 0.3% by mass, as basic characteristics such as mechanical strength and electric conductivity are not deteriorated. For example, since B is effective for suppressing crystal grains from being coarsened thereby for improving the strength, the element is effectively added in an amount of 0.005 to 0.1% by mass to such an extent as not to decrease the electric conductivity. Ti, Zr, V, Al, Pb and Bi may be contained, as the content of each element, generally in the range of 0.005 to 0.15% by mass, preferably in the range of 0.005 to 0.1% by mass. When the contents of Pb and Bi are too large, for example, the copper alloy wire obtained may be poor in bending property.

The balance of the components described above is comprised of Cu and inevitable impurities, in the copper alloys for use in the present invention.

The following composition ranges are examples of the preferable composition ranges of the copper alloys used for the wire of the present invention.

The first example of the composition of the copper alloy comprises 1.0 to 3.0% by mass of Ni, 0.2 to 0.7% by mass of Si, 0.05 to 1.5% by mass of Sn, and less than 0.005% (including zero) by mass of S, with the balance being Cu and inevitable impurities. More preferably, the copper alloy comprises 1.8 to 3.0% by mass of Ni, 0.4 to 0.7% by mass of Si, 0.1 to 0.35% by mass of Sn, and less than 0.005% (including zero) by mass of S, with the balance being Cu and inevitable impurities. Further preferably, the copper alloy comprises 2.2 to 2.4% by mass of Ni, 0.52 to 0.57% by mass of Si, 0.12 to 0.26% by mass of Sn, and less than 0.005% (including zero) by mass of S, with the balance being Cu and inevitable impurities.

The second example of the composition of the copper alloy comprises 1.0 to 3.0% by mass of Ni, 0.2 to 0.7% by mass of Si, 0.05 to 1.5% by mass of Sn, 0.2 to 1.5% by mass of Zn, and less than 0.005% (including zero) by mass of S, with the balance being Cu and inevitable impurities. More preferably, the copper alloy comprises 1.8 to 3.0% by mass of Ni, 0.4 to 0.7% by mass of Si, 0.1 to 0.35% by mass of Sn, 0.3 to 0.8% by mass of Zn, and less than 0.005% (including zero) by mass of S, with the balance being Cu and inevitable impurities. Further preferably, the copper alloy comprises 2.2 to 2.4% by mass of Ni, 0.52 to 0.5.7% by mass of Si, 0.12 to 0.26% by mass of Sn, 0.45 to 0.55% by mass of Zn, and less than 0.005% (including zero) by mass of S, with the balance being Cu and inevitable impurities.

The third example of the composition of the copper alloy comprises 1.0 to 3.0% by mass of Ni, 0.2 to 0.7% by mass of Si, 0.05 to 1.5% by mass of Sn, 0.2 to 1.5% by mass of Zn, 0.01 to 0.2% by mass of Mg, and less than 0.005% (including zero) by mass of S, with the balance being Cu and inevitable impurities. More preferably, the copper alloy comprises 1.8 to 3.0% by mass of Ni, 0.4 to 0.7% by mass of Si, 0.1 to 0.35% by mass of Sn, 0.3 to 0.8% by mass of Zn, 0.05 to 0.17% by mass of Mg, and less than 0.005% (including zero) by mass of S, with the balance being Cu and inevitable impurities. Further preferably, the copper alloy comprises 2.2 to 2.4% by mass of Ni, 0.52 to 0.57% by mass of Si, 0.12 to 0.26% by mass of Sn, 0.45 to 0.55% by mass of Zn, 0.08 to 0.16% by mass of Mg, and less than 0.005% (including zero) by mass of S, with the balance being Cu and inevitable impurities.

The fourth example of the composition of the copper alloy comprises 3.0 to 4.5% by mass of Ni, 0.7 to 1.1% by mass of Si, 0.05 to 1.5% by mass of Sn, and less than 0.005% (including zero) by mass of S, with the balance being Cu and inevitable impurities. More preferably, the copper alloy comprises 3.5 to 4.0% by mass of Ni, 0.8 to 1.0% by mass of Si, 0.1 to 0.35% by mass of Sn, and less than 0.005% (including zero) by mass of S, with the balance being Cu and inevitable impurities. Further preferably, the copper alloy comprises 3.6 to 3.9% by mass of Ni, 0.85 to 0.95% by mass of Si, 0.12 to 0.26% by mass of Sn, and less than 0.005% (including zero) by mass of S, with the balance being Cu and inevitable impurities.

The fifth example of the composition of the copper alloy comprises 3.0 to 4.5% by mass of Ni, 0.7 to 1.1% by mass of Si, 0.05 to 1.5% by mass of Sn, 0.2 to 1.5% by mass of Zn, and less than 0.005% (including zero) by mass of S, with the balance being Cu and inevitable impurities. More preferably, the copper alloy comprises 3.5 to 4.0% by mass of Ni, 0.8 to 1.0% by mass of Si, 0.1 to 0.35% by mass of Sn, 0.3 to 0.8% by mass of Zn, and less than 0.005% (including zero) by mass of S, with the balance being Cu and inevitable impurities. Further preferably, the copper alloy comprises 3.6 to 3.9% by mass of Ni, 0.85 to 0.95% by mass of Si, 0.12 to 0.26% by mass of Sn, 0.45 to 0.55% by mass of Zn, and less than 0.005% (including zero) by mass of S, with the balance being Cu and inevitable impurities.

The sixth example of the composition of the copper alloy comprises 3.0 to 4.5% by mass of Ni, 0.7 to 1.1% by mass of Si, 0.05 to 1.5% by mass of Sn, 0.2 to 1.5% by mass of Zn, 0.01 to 0.2% by mass of Mg, and less than 0.005% (including zero) by mass of S, with the balance being Cu and inevitable impurities. More preferably, the copper alloy comprises 3.5 to 4.0% by mass of Ni, 0.8 to 1.0% by mass of Si, 0.1 to 0.35% by mass of Sn, 0.3 to 0.8% by mass of Zn, 0.05 to 0.17% by mass of Mg, and less than 0.005% (including zero) by mass of S, with the balance being Cu and inevitable impurities. Further preferably, the copper alloy comprises 3.6 to 3.9% by mass of Ni, 0.85 to 0.95% by mass of Si, 0.12 to 0.26% by mass of Sn, 0.45 to 0.55% by mass of Zn, 0.08 to 0.16% by mass of Mg, and less than 0.005% (including zero) by mass of S, with the balance being Cu and inevitable impurities.

While the method for producing the copper alloy wire used in the present invention is not particularly restricted, examples of the method include the following processes after rough drawing to form the copper alloy into wire rods:

Solution treatment→aging treatment

Solution treatment→aging treatment→drawing

Solution treatment→drawing

Solution treatment→drawing→aging treatment

Solution treatment→drawing→aging treatment→drawing

The wire produced by any of the processes above may be subjected to an annealing treatment for improving the electric conductivity.

The process for rough drawing to form the wire rod of the copper alloy comprises casting into a billet, forming an extrusion rod by a hot extrusion press, and rough drawing to form a wire rod by wire-drawing and the like. Of course, a further drawing may not always be required at the later steps provided that the diameter of the wire rod roughly drawn is fitted to the final diameter of the desired wire.

For the solution treatment, the wire rod formed by rough drawing is maintained preferably at from 700 to 950° C. for 10 minutes or more, more preferably at from 800° C. to 950° C. for from 10 minutes to 180 minutes, and further preferably at from 850 to 950° C. for from 10 minutes to 120 minutes. For the aging treatment, the wire rod is maintained preferably at from 350 to 600° C. for from 1.5 hours to 10 hours, more preferably at from 400° C. to 600° C. for from 2 hours to 8 hours, and further preferably at from 450 to 600° C. for from 2 hours to 6 hours. By the aging treatment, precipitation of intermetallic compounds is enhanced, to improve the electric conductivity and the strength. Drawing (or wire drawing) means that the wire rod obtained by rough drawing is drawn into a wire having a desired diameter. Wire drawing is preferably applied at room temperature with a reduction ratio ($\eta$) of from 0 to 10. The reduction ratio is defined by a value calculated from $\eta = \ln(S_0/S)$, where $S_0$ is a cross sectional area of the cross section when the wire before wire drawing is cut in the direction vertical to the direction of drawing the wire, and S is a cross sectional area after wire drawing. The reduction ratio ($\eta$) of zero at a step means that no drawing of the wire is applied at the step.

The process for forming plate (or bar) materials cannot be directly employed in the process for producing the wire of the present invention. While the plate material is worked at most with a reduction ratio of up to about 3 by rolling, the wire material should be readily worked with a reduction ratio of 3 or more by drawing. Increment of the strength of the wire material is larger being compared with the plate (or bar) materials, since the wire material is generally worked with the higher degree of reduction ratio. Further, even in the production of the wires with a low degree of reduction ratio, the relationship between the temperature in the aging treatment and characteristics (strength, electric conductivity and the like) is different from that in the production of the plate materials.

Generally, the wire material is subjected to drawing in the production process of the wire according to the present invention, although in some cases no drawing is applied after a solution treatment depending on a composition of a copper alloy or a heat treatment step. Applying the drawing tend to increase the strength of the wire obtained, and to decrease the resistance to stress relaxation. The present invention resolves these problems peculiar to the wire production and provides the wires with desired strength and resistance to stress relaxation.

The wire of the present invention is excellent in drawing property. Drawing property as used herein refers to property (formability) for re-drawing a given wire, wherein break of the wire seldom occurs and wear of a drawing dies is little during re-drawing. Drawing property is evaluated, for example, by counting the number of incidence of break of wire when a material having a given length (or a given mass) is subjected to drawing. Regarding wear of drawing dies, there is such a method as wear of drawing die is evaluated, for example, by measuring the diameters of the wire at the start of drawing and after completing drawing, when a material having a given length (or a given mass) is subjected to drawing.

Next, preferable methods for producing the high strength, high-conductivity copper alloy wire of the present invention used for electronic and electrical machinery and tools will be described hereinafter.

The inventors have performed experiments by variously changing the combinations among the solution treatment, aging treatment and drawing conditions. Consequently, it was found that the precipitation behaviors of the Cu—Ni—Si compound that is responsible for increasing the strength and electric conductivity are influenced by the reduction ratio or the like in the processing steps of the wire.

In the production process of the copper alloy wire of the present invention, the wire is subjected to a finishing drawing wherein the wire is finished to a desired diameter, for example, after aging following the solution treatment, or after aging following drawing after the solution treatment.

The methods for obtaining an especially high strength wire will be described below.

<The Methods Described in Items (7) and (8) Above>

With respect to the increment of the strength by both work hardening in the intermediate drawing and precipitation hardening in the aging treatment, the degree of increment of the strength by the aging treatment is small when the reduction ratio exceeding 4 is applied in the intermediate drawing, and further, the wire is softened by the aging treatment when the reduction ratio in the intermediate drawing is too high. Accordingly, the reduction ratio in the intermediate drawing is defined to be from 0 to 4, preferably from 0.5 to 3. On the other hand, a wire material having mechanical strength of as high as 1,000 MPa or more can be hardly obtained when the reduction ratio in the final finish drawing is less than 3. Accordingly, the reduction ratio in the finish drawing is determined to be 3 or more, preferably from 4 to 10.

Then, by an annealing treatment, the electric conductivity, bending property and resistance to stress relaxation can be improved. The annealing treatment is applied at from 350° C. to 500° C. for 1.5 hours or more, preferably at from 400° C. to 500° C. for from 2 hours to 8 hours.

<The Methods Described in Items (9) and (10) Above>

Although the strength is also increased by drawing without applying the aging treatment after the solution treatment, a sufficient strength cannot be obtained at a reduction ratio of less than 7. Accordingly, the reduction ratio is determined to be 7 or more, preferably from 8.5 to 10.

The electric conductivity, bending property and resistance to stress relaxation can be improved by applying an annealing treatment to the extent that the tensile strength does not decrease. The wire is annealed at from 200° C. to 400° C. for 1.5 hours or more, preferably at from 250° C. to 350° C. for from 2 hours to 8 hours.

The methods for obtaining a higher conductivity wire will be described below.

<The Methods Described in Item (11) Above>

The rate of increment of the electric conductivity after the aging treatment is increased more as the reduction ratio in the intermediate drawing is higher, when the aging treatment is applied after applying the intermediate drawing after the solution treatment. On the other hand, the electric conductivity is more decreased as the reduction ratio in the finish drawing is higher, when the wire is subjected to a finishing drawing after the aging treatment. Therefore, it is preferable that the reduction ratio in the intermediate drawing is made larger and the reduction ratio in the finish drawing is made to be as small as possible, or the finish drawing is not applied at all, for obtaining a wire having a higher electric conductivity. Accordingly, the reduction ratio after the solution treatment (in the intermediate drawing) is determined to be 3 or more, preferably from 4 to 10, and the reduction ratio after the aging treatment (in the finish drawing) is determined to be from 0 to less than 3, preferably from 0.5 to 2. The above aging treatment is applied at from 400° C. to 600° C. for 1.5 hours or more, preferably at from 450° C. to 550° C. for from 2 hours to 8 hours.

The methods for obtaining a wire in good balance between the mechanical strength and electric conductivity will be described below.

<The Methods Described in Item (12) Above>

A fine balance between the reduction ratio in the intermediate drawing and the reduction ratio in the finish drawing is necessary for obtaining the wire in good balance between the strength and the electric conductivity. When the reduction ratio in the intermediate drawing is less than 0.7, a sufficient improvement of the conductivity cannot be attained in the succeeding aging treatment and the electric conductivity rather decreases in the finish drawing after the aging treatment. When the reduction ratio in the intermediate drawing exceeds 4, the electric conductivity is largely improved in the aging treatment, however, the age hardening is not manifested on the strength, and the wire is rather softened. In this case, if the wire is subjected to a drawing with a high degree of reduction ratio in the finish drawing step after the aging treatment in order to compensate the strength decreased owing to softening, the electric conductivity is decreased. Accordingly, the reduction ratio in the intermediate drawing between the solution treatment and the aging treatment is from 0.7 to 4, preferably from 1 to 3. The reduction ratio in the finish drawing is defined to be less than 6, preferably from 0.5 to 5, because, when the reduction ratio is 6 or more, the conductivity is decreased to less than 30% IACS by applying a drawing. The above aging treatment is preferably applied at from 400° C. to 600° C. for 1.5 hours or more, more preferably at from 450° C. to 550° C. for from 2 to 8 hours.

<The Methods Described in Item (13) Above>

In another method, the wire is finished to a desired diameter by allowing the strength and electric conductivity to gradually increase by repeating a sequence of a drawing, an aging treatment and an annealing treatment after the solution treatment. The reduction ratio in the drawing between the respective heat treatments is defined to be more than 0 and 4 or less, preferably from 0.5 to 3, because the electric conductivity is decreased too low when the reduction ratio exceeds 4 that a sufficient electric conductivity cannot be attained in the succeeding aging treatment or the annealing treatment. The temperatures in the annealing treatment applied in the next step and thereafter are made to be lower than the temperature in the first aging treatment, since, when the temperature of the annealing treatment in the next step is higher than the temperature in the first aging treatment, the precipitates formed in the former step is dissolved again as a solid solution, and the effect of the aging treatment in the former step is canceled. The aging treatment as the first heat treatment is preferably applied at a temperature of from 400° C. to 600° C. for 1.5 hours or more, more preferably at from 450° C. to 550° C. for from 2 hours to 8 hours in the heat treatment after the solution treatment. The annealing treatment as a second heat treatment and thereafter is preferably applied at from 300° C. to 550° C. (more preferably at from 300° C. to 500° C.), and at a temperature lower than the first aging temperature for 1.5 hours or more (more preferably from 2 to 8 hours).

Repeating the drawing and the annealing twice or more in this method, for example, solution treatment→drawing→aging treatment→(drawing→annealing)$_n$→finish drawing (n is an integer of 2 or more), means that at least twice annealing treatments are applied. The annealing treatment may be the final treatment by omitting the finish drawing.

<The Methods Described in Item (14) Above>

In still another method, the wire is finished to a desired diameter by rough drawing to form a wire rod before the solution treatment and then applied with both the solution treatment and the aging treatment. The aging treatment above is applied at from 400° C. to 600° C. for 1.5 hours or more, preferably at from 450° C. to 550° C. for from 2 to 8 hours.

It is also preferable to apply plating on the copper alloy wire for the electronic and electric machinery and tools of the present invention. The plating method is not particularly restricted, and conventionally used methods may be employed.

While the diameter of the copper alloy wire of the present invention is not particularly restricted, and is appropriately determined depending on the uses, it is preferably 10 μm or more, more preferably from 50 μm to 5 mm.

The copper alloy wire of the present invention is excellent in the strength, the electric conductivity and the resistance to stress relaxation.

Further, the copper alloy wire of the present invention is excellent in bending property, straightness and roundness as well as platability by, for example, gold plating. The copper alloy wire of the present invention is also excellent in drawing property when the wire is subjected to an additional drawing.

Furthermore, since the copper alloy wire of the present invention requires no beryllium at all, drawbacks of the wire made of beryllium copper alloy are conquered to afford excellent advantages that the wire could be manufactured with low cost and with high safety in the production process.

According to the method of the present invention, the copper alloy wire having these excellent characteristics and properties can be safely produced with low production costs.

EXAMPLES

The present invention is described in more detail with reference to the following examples, but the present invention is not meant to be limited to these examples.

Billets were produced by melting and casting the alloys having the compositions, as shown in Table 1, in a high-frequency furnace. The billets were subjected to hot extrusion, followed by cold (wire drawing) working, to produce wire rods with a diameter of 15 mm. These wire rods were subjected to solution treatment (at 900° C. for 90 minutes), and then drawing with a reduction ratio η of 0.7, to obtain wires with a diameter of 0.5 mm. These wires were subjected to aging treatment at 500° C. for 2 hours in an inert gas atmosphere, and then drawing at a reduction ratio η of 2.3, to produce wires with a diameter of 0.15 mm. The wires thus obtained were evaluated with respect to various characteristics.

The tensile strength was measured according to JIS Z2241, and the electric conductivity was measured according to JIS H0505.

For evaluating repeated bending property, a weight was hung at the end of the test wire so as to give a load of 230 g, the wire was repeatedly bent to 90°, and the number of bending before break of the wire was counted. One reciprocating bending was counted as one time of bending, and the number of bending before breakage was averaged for five wires for each testing condition. The wire capable of five times or more of bending before breakage is evaluated as successful.

For evaluating bending property, the wire was subjected to closely contact bending, wherein the wire was bent to 180° toward the inside with an inner radius of curvature of 0 mm.

The evaluation indices are the following ranks:

A: excellent with no wrinkles;

B: tiny wrinkles are observed;

C: while large wrinkles are observed, no cracks are generated yet;

D: fine cracks are observed; and

E: cracks are obviously observed.

The evaluation ranks A, B and C are judged to be levels of no practical problems, and the evaluation ranks D and E are judged to be problematic level.

Resistance to stress relaxation was measured by an open sided block method according to the Standard of the Electronic Materials Manufacturers Association of Japan (EMAS-3003). The load stress was set so that the maximum surface stress would be 80% of the proof stress, and the stress relaxation ratio (SRR) was determined by holding the sample in a constant temperature chamber at 150° C. for 1,000 hours.

Results are shown in Table 2.

TABLE 1

| | Alloy No. | Alloy composition (mass %) Ni | Si | Sn | S | Zn | Others | Cu |
|---|---|---|---|---|---|---|---|---|
| Examples according to this invention | 1 | 1.2 | 0.28 | 0.17 | 0.001 | | | Balance |
| | 2 | 2.2 | 0.52 | 0.21 | 0.002 | | | Balance |
| | 3 | 3.5 | 0.86 | 0.13 | 0.003 | | | Balance |
| | 4 | 4.2 | 1.03 | 0.33 | 0.002 | | | Balance |
| | 5 | 2.3 | 0.50 | 0.08 | 0.001 | | | Balance |
| | 6 | 2.5 | 0.55 | 1.21 | 0.004 | | | Balance |
| | 7 | 3.6 | 0.88 | 0.11 | 0.001 | | | Balance |
| | 8 | 3.8 | 0.90 | 1.32 | 0.003 | | | Balance |
| | 9 | 1.9 | 0.47 | 0.22 | 0.002 | | 0.18 Ag | Balance |
| | 10 | 3.3 | 0.77 | 0.10 | 0.001 | | 0.22 Ag | Balance |
| | 11 | 2.0 | 0.50 | 0.33 | 0.002 | | 0.23 Mn | Balance |
| | 12 | 3.9 | 0.90 | 0.38 | 0.003 | | 0.32 Mn | Balance |
| | 13 | 2.5 | 0.61 | 0.25 | 0.002 | | 0.15 Mg | Balance |
| | 14 | 4.0 | 0.95 | 0.10 | 0.001 | | 0.21 Mn, 0.11 Fe | Balance |
| | 15 | 3.8 | 0.88 | 0.20 | 0.001 | | 0.05 Fe, 0.15 Cr | Balance |
| | 16 | 2.4 | 0.80 | 0.23 | 0.002 | | 0.10 Ag, 1.05 Co | Balance |
| | 17 | 2.7 | 0.65 | 0.18 | 0.003 | | 0.05 P | Balance |
| | 18 | 3.0 | 0.68 | 0.27 | 0.001 | | 0.19 Mg, 0.05 Pb | Balance |
| | 19 | 2.4 | 0.52 | 0.17 | 0.002 | 0.26 | | Balance |
| | 20 | 2.2 | 0.54 | 0.21 | 0.004 | 1.32 | | Balance |
| | 21 | 3.6 | 0.85 | 0.15 | 0.001 | 0.37 | | Balance |
| | 22 | 3.8 | 0.89 | 0.12 | 0.002 | 1.26 | | Balance |
| | 23 | 2.2 | 0.55 | 0.23 | 0.002 | 0.60 | 0.24 Ag | Balance |
| | 24 | 3.7 | 0.90 | 0.15 | 0.001 | 0.49 | 0.13 Ag | Balance |
| | 25 | 2.1 | 0.42 | 0.16 | 0.001 | 0.48 | 0.10 Mn | Balance |
| | 26 | 2.4 | 0.56 | 0.18 | 0.003 | 0.58 | 0.47 Mn | Balance |
| | 27 | 3.5 | 0.86 | 0.19 | 0.002 | 0.57 | 0.12 Mn | Balance |
| | 28 | 3.2 | 0.73 | 0.21 | 0.003 | 0.60 | 0.40 Mn | Balance |
| | 29 | 2.3 | 0.56 | 0.17 | 0.001 | 0.52 | 0.09 Mg | Balance |
| | 30 | 3.8 | 0.91 | 0.15 | 0.002 | 0.49 | 0.12 Mg | Balance |
| | 31 | 2.6 | 0.45 | 0.22 | 0.002 | 0.32 | 0.12 Fe | Balance |
| | 32 | 2.4 | 0.53 | 0.24 | 0.001 | 0.43 | 0.26 Mn, 0.14 Fe | Balance |
| | 33 | 3.3 | 0.78 | 0.18 | 0.001 | 0.42 | 0.08 Cr, 0.03 B | Balance |
| | 34 | 2.3 | 0.77 | 0.15 | 0.001 | 0.68 | 1.20 Co | Balance |
| | 35 | 2.8 | 0.65 | 0.13 | 0.004 | 0.62 | 0.04 P | Balance |
| | 36 | 2.1 | 0.45 | 0.18 | 0.002 | 0.32 | 0.02 Ag, 0.07 Pb | Balance |
| | 37 | 3.5 | 0.86 | 0.17 | 0.003 | 0.52 | 0.23 Mn, 0.02 Bi | Balance |
| Comparative example | 38 | 0.5 | 0.24 | 0.16 | 0.001 | | | Balance |
| | 39 | 5.2 | 0.92 | 0.17 | 0.001 | | | Balance |
| | 40 | 1.2 | 0.11 | 0.13 | 0.002 | | | Balance |
| | 41 | 3.9 | 1.93 | 0.18 | 0.004 | | | Balance |
| | 42 | 3.2 | 0.65 | 0.02 | 0.002 | | | Balance |
| | 43 | 3.4 | 0.72 | 2.40 | 0.003 | | | Balance |
| | 44 | 2.5 | 0.62 | 0.21 | 0.15 | | | Balance |
| | 45 | 3.0 | 0.80 | 0.13 | 0.001 | 2.31 | | Balance |
| | 46 | 3.2 | 0.66 | 0.19 | 0.002 | 0.62 | 1.13 Mn | Balance |
| | 47 | 2.6 | 0.61 | 0.15 | 0.001 | 0.46 | 1.02 Mg | Balance |
| | 48 | 2.5 | 0.48 | 0.20 | 0.003 | 0.30 | 0.56 Fe | Balance |
| | 49 | 3.1 | 0.68 | 0.16 | 0.002 | 0.45 | 0.45 Cr | Balance |
| | 50 | 2.6 | 0.54 | 0.16 | 0.003 | 0.45 | 0.49 P | Balance |
| Conventional example | 51 | Cu-1.8 mass % Ni-0.3 mass % Be | | | | | | |
| | 52 | Cu-1.9 mass % Be-0.25 mass % Co | | | | | | |

TABLE 2

| | Alloy No. | Tensile strength (MPa) | Electric conductivity (% IACS) | Repeated bending property (times) | Bending property | Resistance to stress relaxation (%) |
|---|---|---|---|---|---|---|
| Examples according to this invention | 1 | 815 | 38.2 | 11.4 | A | 21 |
| | 2 | 1032 | 34.6 | 9.8 | B | 18 |
| | 3 | 1100 | 25.4 | 10.4 | B | 10 |
| | 4 | 1135 | 21.2 | 8.2 | C | 11 |
| | 5 | 1035 | 37.9 | 9.2 | B | 19 |
| | 6 | 1043 | 33.1 | 8.8 | B | 10 |
| | 7 | 1095 | 27.3 | 8.2 | B | 21 |
| | 8 | 1089 | 20.7 | 7.6 | B | 10 |
| | 9 | 1028 | 35.8 | 8.2 | A | 20 |
| | 10 | 1112 | 37.0 | 10.0 | A | 11 |
| | 11 | 1046 | 32.3 | 8.2 | B | 17 |
| | 12 | 1125 | 20.4 | 7.6 | B | 10 |
| | 13 | 1046 | 33.2 | 8.4 | C | 12 |
| | 14 | 1124 | 23.3 | 8.2 | C | 10 |
| | 15 | 1087 | 28.4 | 8.2 | C | 15 |
| | 16 | 1113 | 35.1 | 7.6 | B | 12 |
| | 17 | 1062 | 36.0 | 8.4 | B | 18 |
| | 18 | 1069 | 25.3 | 8.8 | C | 9 |
| | 19 | 1039 | 32.2 | 10.2 | A | 17 |
| | 20 | 1036 | 29.8 | 10.0 | A | 18 |
| | 21 | 1099 | 25.2 | 10.0 | B | 11 |
| | 22 | 1090 | 22.4 | 9.8 | A | 12 |
| | 23 | 1052 | 34.0 | 9.2 | A | 16 |
| | 24 | 1121 | 23.5 | 8.6 | A | 16 |
| | 25 | 1043 | 30.6 | 9.6 | A | 18 |
| | 26 | 1051 | 28.3 | 9.4 | A | 19 |
| | 27 | 1111 | 22.4 | 10.2 | A | 10 |
| | 28 | 1117 | 21.4 | 96.0 | B | 12 |
| | 29 | 1054 | 32.5 | 8.2 | B | 14 |
| | 30 | 1104 | 26.2 | 7.2 | B | 8 |
| | 31 | 1044 | 33.2 | 8.4 | B | 18 |
| | 32 | 1062 | 30.8 | 6.8 | C | 16 |
| | 33 | 1100 | 26.3 | 7.2 | B | 12 |
| | 34 | 1082 | 25.6 | 8.4 | A | 12 |
| | 35 | 1060 | 28.7 | 8.2 | B | 16 |
| | 36 | 1045 | 31.1 | 7.8 | B | 17 |
| | 37 | 1114 | 22.2 | 7.2 | C | 11 |
| Comparative example | 38 | 672 | 44.5 | 10.8 | A | 18 |
| | 39 | 1109 | 20.4 | 6.6 | D | 14 |
| | 40 | 688 | 42.1 | 10.0 | A | 18 |
| | 41 | 1095 | 27.2 | 7.8 | D | 16 |
| | 42 | 1055 | 26.1 | 8.0 | B | 28 |
| | 43 | 1067 | 18.3 | 7.8 | B | 11 |
| | 44 | (Cracked during hot-extrusion. Experiment canceled.) | | | | |
| | 45 | 1042 | 18.3 | 8.2 | A | 14 |
| | 46 | 1077 | 17.8 | 7.4 | B | 13 |
| | 47 | 1050 | 28.7 | 7.2 | D | 9 |
| | 48 | 1044 | 34.3 | 6.8 | D | 17 |
| | 49 | 1057 | 28.7 | 6.4 | D | 15 |
| | 50 | 1054 | 28.0 | 6.0 | D | 19 |
| Conventional example | 51 | 915 | 51.2 | 7.0 | B | 17 |
| | 52 | 1531 | 23.5 | 6.2 | C | 18 |

Table 2 clearly shows that the samples in Examples 1 to 37 according to the present invention are excellent in all the characteristics such as the tensile strength, electric conductivity, repeated bending property and resistance to stress relaxation.

On the other hand, the desired strength cannot be obtained in the sample in Comparative Example 38 containing a too small amount of Ni and in the sample in Comparative Example 40 containing a too small amount of Si. On the contrary, while the strength of the sample in Comparative Example 39 containing a too large amount of Ni is not different from the strength of the samples in Examples 2 to 4 according to the present invention, the former sample is poor in bending property. Further, although the strength of the sample in Comparative Example 41 containing a too large amount of Si is not different from the strength of the samples in Examples 2 to 4 according to the present invention, the former sample is poor in bending property.

Resistance to stress relaxation is conspicuously deteriorated in the sample in Comparative Example 42 containing a too small amount of Sn as compared with the sample in Example 7 according to the present invention. On the contrary, although resistance to stress relaxation of the sample in Comparative Example 43 containing a too large amount of Sn is not so largely different from resistance to stress relaxation of the sample in Example 8 according to the present invention, a desired electric conductivity cannot be obtained in the former sample.

Since cracks were generated in the hot extrusion process in the sample in Comparative Example 44 in which the amount of addition of S exceeds the amount defined in the present invention, the process flow thereafter was canceled.

The electric conductivity became deteriorated in the sample in Comparative example 45 in which the amount of addition of Zn exceeds the amount defined in the present invention.

Although the effect of increasing the strength was observed in the sample in Comparative Example 46 in which the amount of addition of Mn exceeds the amount defined in the present invention as compared with the samples in Examples 25 and 26 according to the present invention containing a smaller amount of Mn, the electric conductivity was deteriorated.

Bending property is poor in the sample in Comparative Example 47 in which the amount of addition of Mg exceeds the amount defined in the present invention, and, although resistance to stress relaxation is improved as compared with the sample in Example 29 according to the present invention, the desired conductivity is deteriorated.

Although the electric conductivity is slightly improved in the sample in Comparative Example 48 in which the amount of addition of Fe exceeds the amount defined in the present invention as compared with the sample in Example 31 according to the present invention, the improvement is not consistent with the amount of addition. Besides, bending property is conspicuously deteriorated.

Although the electric conductivity is slightly improved in the sample in Comparative Example 49 in which the amount of addition of Cr exceeds the amount defined in the present invention as compared with the sample in Example 33 according to the present invention, the improvement is not consistent with the amount of addition. Besides, bending property is conspicuously deteriorated.

Although the strength and electric conductivity of the sample in Comparative Example 50, in which the amount of addition of P exceeds the amount defined in the present invention, are little different from those of the sample in Example 35 according to the present invention, bending property is conspicuously deteriorated.

Then, the alloys having the compositions in Examples 29 and 30 among the alloys in Table 1 were melted and cast into billets. After hot-extrusion of these billets, they were formed into wire rods with a diameter of 15 mm by cold (wire drawing) working. These wire rods were formed into wires with a diameter of 0.15 mm by applying any one of the steps A to L shown in Table 3. Likewise, the alloys having the compositions in Examples 29 and 30 were melted and cast into billets and, after hot extrusion of these billets, wires with a diameter of 0.15 mm were formed by applying any one of the steps M, N, O and P shown in Table 3. Various characteristics as shown above were evaluated using the wires obtained above. The results are shown in Table 4.

TABLE 3

| Process No. | Processing steps |
|---|---|
| A | Solution treatment(900° C. × 0.5 h)→Drawing(η = 9)→Aging(450° C. × 2 h) |
| B | Solution treatment(900° C. × 0.5 h)→Drawing(η = 9) |
| C | Solution treatment(900° C. × 0.5 h)→Drawing(η = 9)→Aging(350° C. × 2 h) |
| D | Solution treatment(900° C. × 0.5 h)→Aging(500° C. × 2 h)→Drawing(η = 7) |
| E | Solution treatment(900° C. × 0.5 h)→Drawing(η = 3)→Aging(450° C. × 2 h)→Drawing(η = 4) |
| F | Solution treatment(900° C. × 0.5 h)→Drawing(η = 3)→Aging(450° C. × 2 h)→Drawing(η = 0.9) |
| G | Solution treatment(900° C. × 0.5 h)→Drawing(η = 4.5)→Aging(450° C. × 2 h)→Drawing(η = 0.7) |
| H | Solution treatment(900° C. × 0.5 h)→Drawing(η = 0.7)→Aging(450° C. × 2 h)→Drawing(η = 6.3)→Annealing(400° C. × 2 h) |
| I | Solution treatment(900° C. × 0.5 h)→Drawing(η = 3)→Aging(525° C. × 2 h)→Drawing(η = 4) |
| J | Solution treatment(900° C. × 0.5 h)→Drawing(η = 2.3)→Aging(500° C. × 2 h)→Drawing(η = 2.3)→Annealing(350° C. × 2 h)→Drawing(η = 2.3)→Annealing(325 × 2 h) |
| K | Solution treatment(900° C. × 0.5 h)→Drawing(η = 9)→Annealing(300° C. × 2 h) |
| L | Solution treatment(900° C. × 0.5 h)→Aging(500° C. × 2 h) |
| M | Solution treatment(900° C. × 0.5 h) |
| N | Drawing(η = 9.8) |
| O | Drawing(η = 9.8)→Aging(450° C. × 2 h) |
| P | Aging(450° C. × 2 h)→Drawing(η = 9.8) |

(Note)
Wire-drawing is abbreviated to "Drawing"

TABLE 4

| | | Alloy No. | Process No. | Tensile strength (MPa) | Electric conductivity (% IACS) | Repeated bending property (times) | Bending property | Resistance to stress relaxation (%) |
|---|---|---|---|---|---|---|---|---|
| Examples according to this invention | 53 | 29 | A | 706 | 58.7 | 10.6 | A | 10 |
| | 54 | 29 | B | 1210 | 20.3 | 8.6 | C | 19 |
| | 55 | 29 | C | 1061 | 40.2 | 7.6 | B | 12 |
| | 56 | 29 | D | 1066 | 20.5 | 8.2 | C | 17 |
| | 57 | 29 | E | 1034 | 27.8 | 7.4 | B | 14 |
| | 58 | 29 | F | 929 | 37.1 | 7.8 | B | 11 |
| | 59 | 29 | G | 786 | 43.8 | 6.8 | A | 13 |
| | 60 | 29 | H | 732 | 46.8 | 9.2 | B | 12 |
| | 61 | 29 | I | 943 | 38.4 | 8.8 | B | 15 |

TABLE 4-continued

| | | Alloy No. | Process No. | Tensile strength (MPa) | Electric conductivity (% IACS) | Repeated bending property (times) | Bending property | Resistance to stress relaxation (%) |
|---|---|---|---|---|---|---|---|---|
| | 62 | 29 | J | 964 | 43.3 | 10.0 | B | 14 |
| | 63 | 30 | A | 754 | 52.1 | 9.8 | B | 8 |
| | 64 | 30 | C | 1105 | 34.6 | 7.6 | B | 9 |
| | 65 | 30 | D | 1196 | 21.5 | 6.6 | C | 10 |
| | 66 | 30 | E | 1070 | 22.6 | 7.2 | C | 12 |
| | 67 | 30 | F | 951 | 30.1 | 7.4 | B | 9 |
| | 68 | 30 | G | 813 | 40.8 | 8.6 | B | 7 |
| | 69 | 30 | H | 779 | 40.3 | 7.6 | B | 15 |
| | 70 | 30 | I | 977 | 33.7 | 8.4 | C | 13 |
| | 71 | 30 | K | 1256 | 22.9 | 9.6 | B | 11 |
| | 72 | 30 | L | 915 | 37.0 | 10.8 | B | 10 |
| Compar- | 73 | 29 | M | 350 | 20.2 | 13.2 | A | 12 |
| ative | 74 | 29 | N | 1254 | 19.5 | 7.2 | B | 24 |
| example | 75 | 29 | O | 590 | 56.3 | 7.6 | B | 16 |
| | 76 | 29 | P | 1056 | 19.2 | 7.0 | B | 20 |
| | 77 | 30 | M | 390 | 15.2 | 12.4 | A | 10 |
| | 78 | 30 | N | 1298 | 15.3 | 6.4 | D | 22 |
| | 79 | 30 | 0 | 683 | 53.2 | 7.8 | A | 13 |
| | 80 | 30 | P | 1197 | 14.8 | 6.6 | B | 23 |

Table 4 clearly shows that the samples of the examples according to the present invention are excellent in every evaluated characteristics.

On the contrary, the sample in Comparative Example 73 is poor in the tensile strength. The sample in Comparative Example 74 is poor in the electric conductivity and the resistance to stress relaxation. The sample in Comparative Example 75 is poor in the tensile strength. The sample in Comparative Example 76 is poor in the electric conductivity.

Further, the sample in Comparative Example 77 is poor in both the tensile strength and the electric conductivity. The sample in Comparative Example 78 is poor in the electric conductivity, the bending property and the resistance to stress relaxation. The sample in Comparative Example 79 is poor in the tensile strength. The sample in Comparative Example 80 is poor in both the electric conductivity and the resistance to stress relaxation.

INDUSTRIAL APPLICABILITY

The high-strength, high-conductivity copper alloy wire of the present invention being excellent in resistance to stress relaxation is preferable as high-strength, high-conductivity copper alloy wires for parts of electronic and electric machinery and tools, particularly preferable as pins such as IC socket pins, connector pins, or the like, terminals such as terminals for butteries, conductors such as flat cable conductors, wiring cable conductors for machinery and tools, or the like, and spring materials such as coil springs.

The method of the present invention is advantageous for producing the high-strength, high-conductivity copper alloy wire being excellent in resistance to stress relaxation.

Having described our invention as related to the present embodiments, it is our intention that the present invention not be limited by any of the details of the description, unless otherwise specified, but rather be construed broadly within its spirit and scope as set out in the accompanying claims.

The invention claimed is:

1. A method for producing a high-strength, high-conductivity copper alloy wire that is excellent in resistance to stress relaxation, comprising the following steps in the following order:

rough drawing a copper alloy comprising 1.0 to 4.5% by mass of Ni, 0.2 to 1.1% by mass of Si, 0.05 to 1.5% by mass of Sn, and less than 0.005% (including zero) by mass of S, optionally 0.2 to 1.5% by mass of Zn, and optionally one or plural elements selected from the group consisting of 0.005 to 0.3% by mass of Ag, 0.01 to 0.5% by mass of Mn, 0.01 to 0.2% by mass of Mg, 0.005 to 0.2% by mass of Fe, 0.005 to 0.2% by mass of Cr, 0.05 to 2% by mass of Co, and 0.005 to 0.1% by mass of P in a total amount of 0.005 to 2% by mass, with the balance being Cu and inevitable impurities, to form a wire rod;

subjecting the wire rod to a solution treatment;

intermediate drawing at a reduction ratio of 3 or more;

aging at from 400° C. to 600° C. for 1.5 hours or more; and final drawing at a reduction ratio of from 0 to less than 3, thereby obtaining a copper alloy wire having a conductivity of 40% IACS or more and a tensile strength of 700 MPa or more.

2. The method of claim 1, wherein the reduction ratio of the intermediate drawing step is from 4 to 10.

3. The method of claim 1, wherein the reduction ratio of the final drawing step is from 0.5 to 2.

4. The method of claim 1, wherein the aging step is conducted under conditions at a temperature from 450° C. to 550° C. for a time period from 2 hours to 8 hours.

* * * * *